US009466247B2

(12) United States Patent
Aubert et al.

(10) Patent No.: US 9,466,247 B2
(45) Date of Patent: Oct. 11, 2016

(54) DRIVING OF ELECTROWETTING DISPLAY DEVICE

(71) Applicant: Liquavista B.V., Eindhoven (NL)

(72) Inventors: Jozef Elisabeth Aubert, Roermond (NL); Henricus Petronella Maria Derckx, Weert (NL); Bokke Johannes Feenstra, Nuenen (NL); Anthony John Slack, Lorgues (FR)

(73) Assignee: Amazon Technologies, Inc., Seattle, WA (US)

( * ) Notice: Subject to any disclaimer, the term of this patent is extended or adjusted under 35 U.S.C. 154(b) by 19 days.

(21) Appl. No.: 14/309,174

(22) Filed: Jun. 19, 2014

(65) Prior Publication Data

US 2014/0300594 A1 Oct. 9, 2014

Related U.S. Application Data

(63) Continuation of application No. PCT/EP2012/076049, filed on Dec. 18, 2012.

(30) Foreign Application Priority Data

Dec. 20, 2011 (GB) ..... 1121928.4

(51) Int. Cl.
*G09G 3/34* (2006.01)
*G09G 5/18* (2006.01)

(52) U.S. Cl.
CPC ..... *G09G 3/348* (2013.01); *G09G 5/18* (2013.01); *G09G 2310/0256* (2013.01); *G09G 2320/0204* (2013.01); *G09G 2320/0219* (2013.01); *G09G 2320/043* (2013.01)

(58) Field of Classification Search
CPC ..... G02B 26/005; G02B 26/004; G02B 2207/115; G02B 1/06; G09G 3/348; G09G 3/3433
See application file for complete search history.

(56) References Cited

U.S. PATENT DOCUMENTS

| | | | | |
|---|---|---|---|---|
| 4,100,579 | A | 7/1978 | Ernstoff | |
| 5,414,443 | A | 5/1995 | Kanatani et al. | |
| 6,392,626 | B1 | 5/2002 | Moon | |
| 7,834,837 | B2 | 11/2010 | Syu et al. | |
| 2007/0146893 | A1 | 6/2007 | Kuiper et al. | |
| 2010/0149150 | A1 | 6/2010 | Chen | |
| 2011/0007056 | A1 | 1/2011 | Huitema | |
| 2011/0025668 | A1* | 2/2011 | Huitema | G09G 3/348 345/211 |
| 2011/0032276 | A1* | 2/2011 | Chen | G09G 3/3433 345/690 |
| 2013/0009938 | A1* | 1/2013 | Hwang | G09G 3/348 345/212 |

FOREIGN PATENT DOCUMENTS

| | | | |
|---|---|---|---|
| CN | 101355836 | A | 1/2009 |
| CN | 101710210 | A | 5/2010 |
| CN | 101847371 | A | 9/2010 |

(Continued)

*Primary Examiner* — Alexander Eisen
*Assistant Examiner* — Cory Almeida
(74) *Attorney, Agent, or Firm* — EIP US LLP

(57) ABSTRACT

A method of driving an electrowetting display device including at least one pixel, the method comprising: applying a first pixel voltage to the pixel during a first portion of the display period; and applying a second pixel voltage to the pixel during a second portion of the display period, the first and second pixel voltages corresponding to a display state of the pixel, and the first pixel voltage and the second pixel voltage having different polarities.

24 Claims, 3 Drawing Sheets

(56) References Cited

FOREIGN PATENT DOCUMENTS

| | | | |
|---|---|---|---|
| JP | H07253765 | A | 10/1995 |
| JP | 2007508576 | A | 4/2007 |
| JP | 2007518132 | A | 7/2007 |
| JP | 2007531009 | A | 11/2007 |
| JP | 2008065308 | A | 3/2008 |
| TW | 201128223 | A | 8/2011 |
| WO | 03071346 | A1 | 8/2003 |
| WO | 03079323 | A1 | 9/2003 |
| WO | 2005036517 | A1 | 4/2005 |
| WO | 2007049196 | A2 | 5/2007 |
| WO | 2008119774 | A1 | 10/2008 |
| WO | 2011115480 | A1 | 9/2011 |

* cited by examiner

DRIVING OF ELECTROWETTING DISPLAY DEVICE

CROSS REFERENCE TO RELATED APPLICATIONS

This application is a continuation of PCT International Application No. PCT/EP2012/076049 filed Dec. 18, 2012.

BACKGROUND

A known electrowetting display device has a plurality of picture elements or pixels and a method of driving a pixel. The pixel includes a first, non-conducting fluid and a second, conductive fluid. The position of the first fluid in the pixel is controlled by the applied voltage and causes a display effect providing a display state of the pixel. When driving the pixel, the polarity of the voltage applied to a pixel changes between each subsequent frame or scan period. The known method, combined with application of an alternating voltage on the second fluid and a constant voltage on one of the plates of a storage capacitor of the pixel, is stated to solve the problem of a dependence of a threshold voltage of the pixel on the specific display device and first fluid used therein. The known display device operated by the known method shows an unsatisfactory display of images.

It is desirable to provide a method for operating an electrowetting display device having an improved display of images.

DETAILED DESCRIPTION

Figure 1:
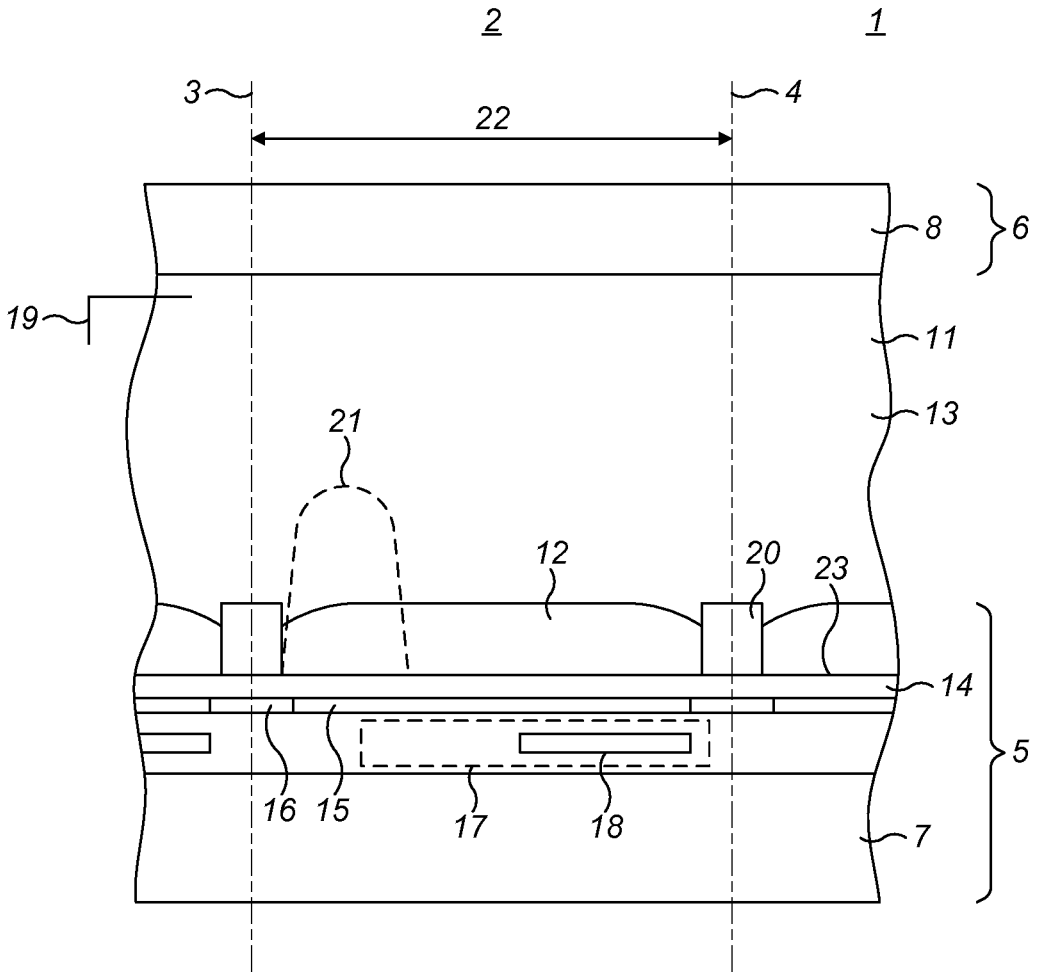
FIG. 1 shows a schematic cross-section of part of an electrowetting display device according to an embodiment.

The contents of the following applications are incorporated by reference herein:

PCT Application No. PCT/EP2012/076049 filed Dec. 18, 2012

GB Application No. 1121928.4 filed Dec. 20, 2011.

Embodiments described herein relate to a method of driving an electrowetting display device, a display driving system adapted for using the method and a display apparatus including a display driving system and an electrowetting display device.

In accordance with first embodiments, there is provided a method of driving an electrowetting display device including at least one pixel, the method comprising the following steps for maintaining a display state of the pixel during a display period:

- applying a first pixel voltage to the pixel during a first portion of the display period, the first pixel voltage corresponding to the display state; and
- applying a second pixel voltage to the pixel during a second portion of the display period, the second pixel voltage corresponding to the display state and the first pixel voltage and the second pixel voltage having different polarities.

The images displayed by the known display device are unsatisfactory in that the display state is not maintained at longer display periods, i.e. at low frame rates, in spite of the fact that the pixel voltage is kept at the same level during the display period. The method according to embodiments inverts the polarity of the pixel voltage during a display period. The inversion of the polarity during the display period improves the maintenance of the display state during the display period.

A pixel voltage corresponds to a desired display state if a prolonged application of the pixel voltage to a pixel results in the pixel showing the display state relating to display input data. The desired display state is usually obtained after a short settling time; the settling time for common electrowetting pixels is of the order of a few milliseconds and usually less than 5 ms. A display period is the period during which the desired display state is to be maintained; its duration is equal to a frame for images displayed in frames.

When the display period of a display device is relatively long, e.g. 100 ms or 1 s, the gradual deterioration of the display state can be countered by inverting the polarity of the voltage two or more times during the display period, thereby maintaining substantially the same display state of the pixel. The method may also include an inversion of the polarity at the start of a display period. The ability to maintain the display state during long display periods makes embodiments suitable for driving an electrowetting display device at low frequencies.

Other embodiments relate to a method of driving an electrowetting display device including at least one pixel for providing a display state in response to a pixel voltage applied to the pixel, the pixel voltage corresponding to display input data, the method comprising the following steps:

- applying a first pixel voltage during a first period for providing a first display state using a first conversion from display input data to pixel voltage magnitude; and
- applying a second pixel voltage during a second period for providing a second display state using a second, different conversion from display input data to pixel voltage magnitude, the first pixel voltage and the second pixel voltage having different polarities.

The images displayed by the known display device are unsatisfactory in that the display state of a pixel has been discovered to be different when being driven with a positive pixel voltage and a negative pixel voltage of the same magnitude. Hence, subsequent frames show different display states when driven by the same magnitude of the pixel voltage. The method according to embodiments compensates for this difference by using different conversions from display input data to magnitude of pixel voltage for positive and negative pixel voltages. The magnitude of a voltage is its absolute value or modulus. The two periods may be consecutive. Embodiments also relate to a display driving system using two conversions.

Further embodiments relate to a method of driving an electrowetting display device including

- at least one pixel having a first electrode and a storage capacitor and
- a second electrode, the storage capacitor being directly connected between the first electrode and the second electrode, the method comprising the following steps:

- applying a first pixel voltage between the first electrode and the second electrode during a first period for providing a first desired display state; and
- applying a second pixel voltage between the first electrode and the second electrode during a second period for providing a second desired display state, the first pixel voltage and the second pixel voltage having different polarities.

The pixel may include a first support plate and a second support plate and a space between the first support plate and the second support plate, the space including at least one first fluid and a second fluid immiscible with each other, the second fluid being electroconductive or polar. The first electrode may be arranged in the first support plate and the second electrode is in contact with the second fluid. The desired display state is a display state to be maintained during a display period.

The images displayed by the known display device are unsatisfactory in that the desired display state is not maintained during a display period. This is caused in part by a storage capacitor in the pixel being connected to the first electrode and to a constant reference voltage. According to embodiments, the storage capacitor is not connected to a constant reference voltage but to the second electrode, thereby assuring that the desired display state is maintained during the display period. Embodiments further relate to a display apparatus having said connection of the storage capacitor.

Embodiments also relate to a display driving system for driving an electrowetting display device having an input for display input data and an output for providing a pixel voltage and a processor for converting the input data to the pixel voltages, wherein the processor is adapted for carrying out the method according to embodiments.

Examples of embodiments will now be described in detail.

FIG. 1 shows a schematic cross-section of part of an electrowetting display device 1. The display device includes at least one picture element or pixel 2, one of which is shown in the Figure. The lateral extent of the pixel is indicated in the Figure by two dashed lines 3, 4. The display device comprises a first support plate 5 and a second support plate 6. The support plates may be separate parts of each pixel, but the support plates may be shared in common by the plurality of pixels. The support plates may include a glass or polymer substrate 7, 8 and may be rigid or flexible.

The display device may be of the transmissive, reflective or transflective type. The display device may be of a segmented display device type in which the image is built up of segments and each segment may include one or more pixels. The display device may be an active matrix driven type or a passively driven type. The plurality of pixels may be monochrome. Alternatively, for a full colour display device, the pixels shown in the Figure may be sub-pixels, each sub-pixel having a different colour; alternatively, a different individual pixel may be able to show different colours using colour filters and/or coloured fluids.

A space 11 between the support plates includes two fluids: a first fluid 12 and a second fluid 13, wherein the fluids may, for example, be liquids. The second fluid is immiscible with the first fluid. The second fluid is electrically conductive or polar, and may be, for example, water or a salt solution such as a solution of potassium chloride in a mixture of water and ethyl alcohol. The second fluid may be transparent, but may be coloured. The first fluid is electrically non-conductive and may, for instance, be an alkane like hexadecane or (silicone) oil. The first fluid absorbs at least a part of the optical spectrum. The first fluid may be transmissive for a part of the optical spectrum, forming a colour filter. For this purpose the first fluid may be coloured by addition of pigment particles or dye. Alternatively, the first fluid may be black, i.e. absorbing substantially all parts of the optical spectrum.

A hydrophobic layer 14 is arranged in the support plate 5 and may be transparent or reflective. The hydrophobic layer may be an uninterrupted layer extending over a plurality of pixels 2, as shown in the Figure, or it may be an interrupted layer, each part extending only over one or more pixels 2. The layer may be for instance an amorphous fluoropolymer layer such as AF1600 or another low surface energy polymer. The hydrophobic character causes the first fluid 12 to adhere preferentially to the first support plate 5.

The first support plate 5 includes a first electrode 15 for each pixel. The electrode is separated from the fluids by an electrically insulating cover layer, which may be the hydrophobic layer 14 or an additional insulating layer, not shown in the Figure. Further layers may be arranged between the hydrophobic layer and the electrode. The first electrode 15 can be of any desired shape or form and in this example is planar; it is made of an electrically conducting material and may be transparent or reflective. The electrodes of neighbouring pixels are separated by an insulating layer 16. The first electrode 15 is connected to a circuit 17, schematically indicated in the Figure, for supplying the first electrode with a voltage. A capacitor 18 is part of the circuit.

A second electrode 19 is in contact with the conductive second fluid 13; this electrode may pertain to one pixel or, as in the embodiment of the Figure, may be common to a plurality of or all pixels. The display state of the pixel 2 can be controlled by a pixel voltage $V_p$ applied between the first electrode 15 and the second electrode 19. The electrode 19 and, for each pixel, the electrode 15 are each coupled to a display driving system. In a display device having the elements arranged in a matrix form, the electrodes can be coupled to a matrix of control lines in the first support plate.

The first fluid 12 is confined to a single pixel by walls 20 that follow the extent of the pixel. The walls may extend from the first to the second support plate but may also extend partly from the first support plate to the second support plate. Although the walls are shown as structures of the first support plate 5 that protrude from the planar surface of the hydrophobic layer 14, they may instead be a surface layer of the first support plate that repels the first fluid, such as a hydrophilic layer. The extent of the pixel, indicated by the dashed lines 3 and 4, is defined by the centre of the walls 20. The area of the hydrophobic layer 14 between the walls of a pixel is a display area 22 over which a display effect occurs. The display area 22 lies in the plane of a surface 23 of the hydrophobic layer 14.

When no voltage is applied between the electrodes, the first fluid 12 forms a layer between the walls 20, as shown in the Figure. This layer may have a typical thickness of 4 micrometer. The layer of second fluid 13 may have a typical thickness in the order of 50 micrometer. A typical size of the display area 22 is 160 micrometer by 160 micrometer. Application of a voltage between the first electrode 15 and the second electrode 18 will contract the first fluid, for example against a wall as shown by the dashed shape 21 in the Figure. The shape of the first fluid is controllable by controlling the applied voltage, and is used to operate the picture element as a light valve, providing a display effect over the display area 22. Further details of features of the display device are described in international patent publication no. WO2003/071346, the contents of which is incorporated herein by way of reference.

Figure 2:
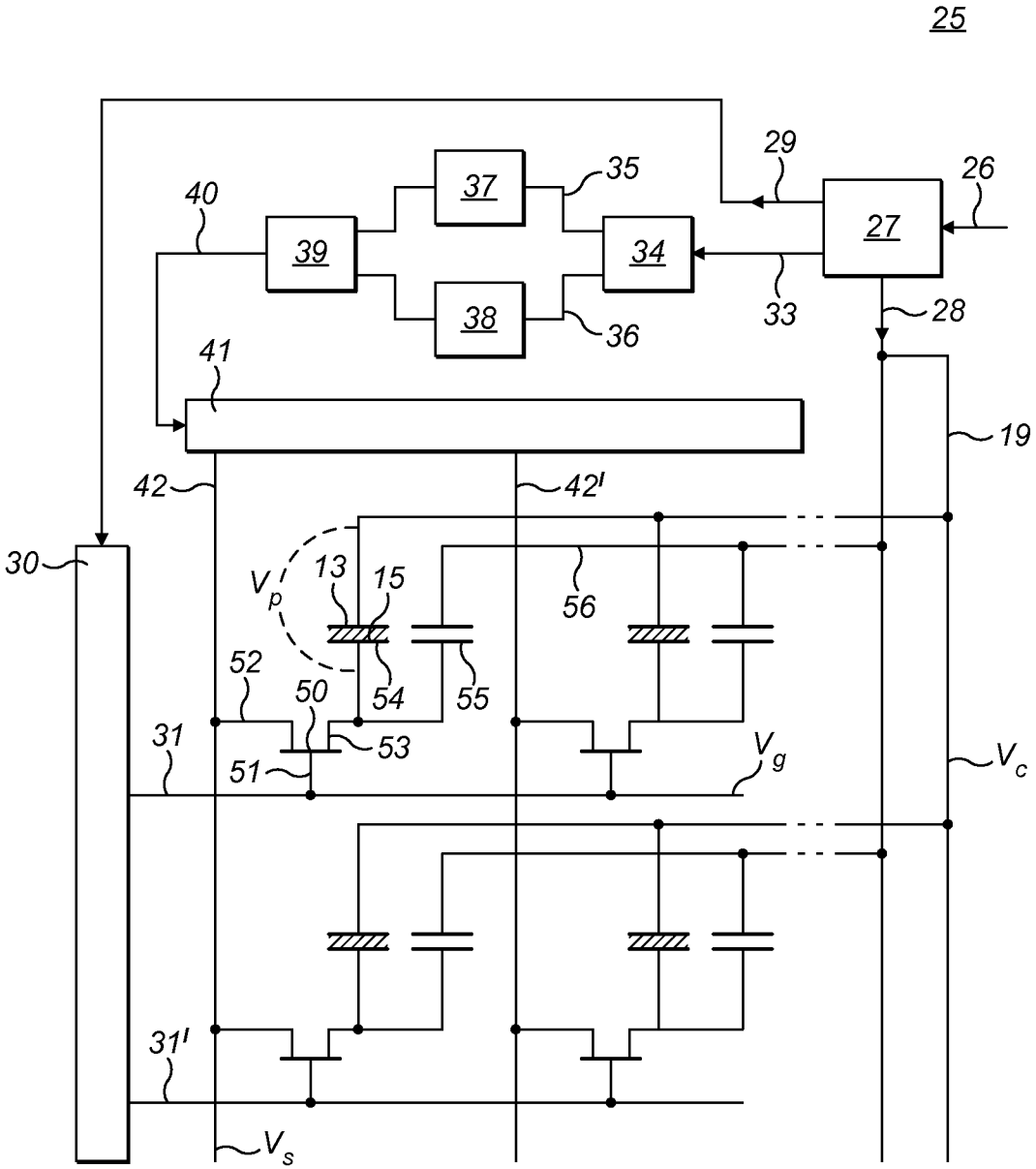
FIG. 2 shows a schematic circuit diagram of a display apparatus according to an embodiment.

FIG. 2 shows a schematic circuit diagram of a display apparatus 25 including a display driving system and an electrowetting display device having an active matrix configuration. Display input data 26 represents images to be displayed on the display device. The data is input to a controller 27, which processes the data. It outputs a signal 28 connected to the electrode 19, common to all pixels of the display device. The signal 28 determines the voltage applied to the second fluid 13. The signal 28 may be a DC signal or an AC signal.

The controller 27 also outputs a control signal 29 with timing information for controlling the gates of the pixels. The control signal 29 is connected to a display row driver 30, which, in dependence on the control signal 29 sends gate pulses over gate control lines 31, 31', also called row control lines. The display driver also includes a driver stage for each gate control line.

The controller 27 further outputs a signal 33 representing the display states for each of the pixels. A controller 34 switches the signal 33 between two outputs 35 and 36, depending on the display cycle, as will be explained below. Output 35 is connected to a first convertor 37 and output 36 to a second convertor 38. The convertors convert the display input data to voltages corresponding to the voltage to be applied to a pixel, i.e. the pixel voltage, to show the display state corresponding to a current value of the display input data. The conversion takes into account the response characteristics of a pixel. Since the characteristics of the pixel may depend on the polarity of the pixel voltage, the conversion carried out by the first convertor 37 for a first polarity of the pixel voltage differs from the conversion carried out by the second convertor 38 for a second polarity inverse to the first polarity. A combiner 39 combines the outputs of the two convertors to a single control signal 40. Each convertor may have the form of a look-up table. The elements 34, 37, 38 and 39 may be combined in a single convertor having two look-up tables, the selection between the two tables being made in dependence on the display cycle.

The control signal 40 is connected to a display column driver 41, which includes a distributor for distributing the voltages in the control signal 40 over source control lines 42, 42', also called column control lines. The display column driver also includes a driver stage for each source control line.

FIG. 2 also shows a circuit diagram of four pixels in the display device, arranged in a matrix configuration. Circuit diagrams for further pixels can be added in a known way. The pixels in the Figure are arranged in horizontal rows and vertical columns.

The circuit of the pixel connected to the control lines 31 and 42 includes a TFT 50 having a gate 51 connected to one of the gate control lines 31, a source 52 connected to one of the source control lines 42, and a drain 53 connected to an element 54, drawn as a capacitor. The lower plate of the capacitor is the electrode 15 of the pixel 2 in FIG. 1. The second fluid 13 is represented by the top plate of the capacitor. The sharing of the second fluid between pixels in the embodiment of FIGS. 1 and 2 is represented by a connection of the top plate of the capacitor of all pixels in the matrix. The top plate is connected to the electrode 19 and set by signal 28. The voltages on the gate control line 31 and the source control line 42 are $V_g$ and $V_s$, respectively. The electrode 19 is at a common voltage Vc. The pixel voltage, i.e. the voltage across the capacitor 54, is $V_p$.

In an embodiment of the display device, the circuit also includes a storage capacitor 55, one plate of which is connected to the drain 53 and the other plate is connected to the corresponding plates of the other pixels by storage capacitor lines 56 in the first support plate 5. The storage capacitor increases the time a pixel can hold a voltage. In a further embodiment the storage capacitor lines 56 are directly connected to the second electrode 19. The phrase 'directly connected' means that the top plate of the storage capacitor 55 and the second fluid 13 have substantially the same voltage during operation of the display device.

The display apparatus shown in FIG. 2 comprises a display driving system and a display device. The display driving system includes a display controller with the elements 27, 34, 37, 38 and 39 and a display driver with the display row driver 30 and the display column driver 41. The display device includes elements 51 to 56. The display driving system may be integrated on the first support plate 5 of the display device. The elements 27, 34, 37, 38 and 39 may be implemented in one or more processors.

The operation of the display apparatus will now be explained with reference to FIG. 3. It shows voltages V for a pixel in FIG. 2 as a function of time t for two frames F1 and F2. A frame is a still image of a video to be displayed. The frame rate refers to the speed at which the image is refreshed. At the start of frame F1 the display controller will address all pixels in the matrix of the display device within a sub-frame SF1 from time $t_1$ to $t_4$ and load the pixels with pixel voltages pertaining to the image of frame F1 of the display input date 26 to be displayed. In a subsequent sub-frame SF2 from time $t_4$ to $t_7$ the same pixel voltages with inverted polarity are loaded. In the following sub-frame SF3, from $t_7$ to the end of frame F1, $t_8$, the pixel voltages are held in the pixels. In the next frame, F2, the next image is displayed.

Figure 3:
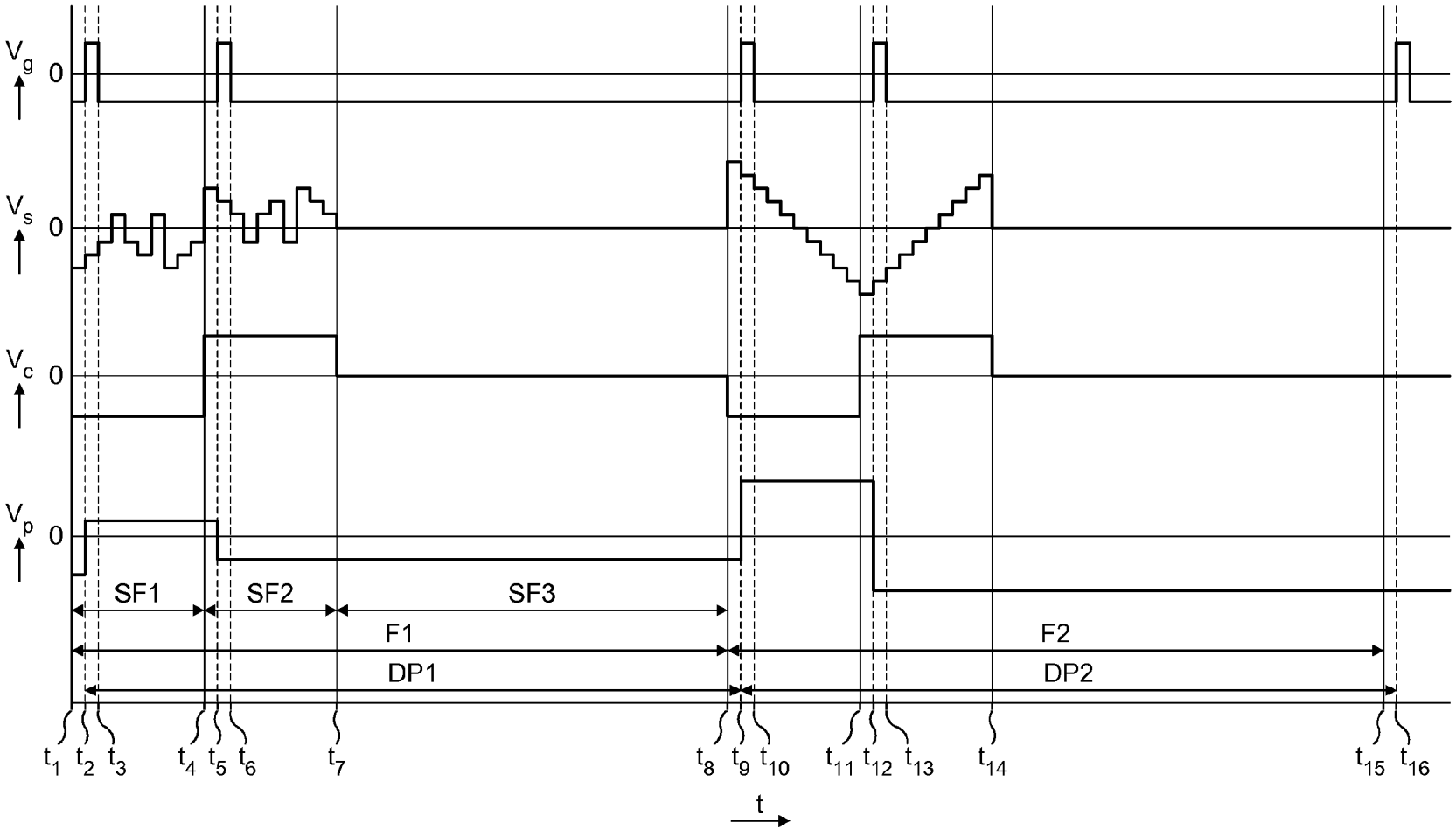
FIG. 3 shows a time diagram of voltages applied to a pixel according to an embodiment.

FIG. 3 shows the voltages for a pixel connected to the control lines 31 and 42 in FIG. 2. During the first sub-frame SF1 the voltage applied to the second fluid $V_c$ is negative, e.g. −15 V and during the second sub-frame SF2 positive, e.g. +15 V. $V_c$ may be zero or any other voltage such as +15 V or −15 V during the third sub-frame SF3.

The source voltage $V_s$ in FIG. 3 is the voltage put on the column control line 42 for providing a pixel voltage for each pixel in the column of the matrix, i.e. one pixel voltage for each row or line. For sake of clarity, the Figure shows only ten voltages, which would correspond to ten lines. In an actual display device there may be for example 480 rows and 640 columns. When in an embodiment the addressing of a line takes 10 microseconds, the duration of sub-frames SF1 and SF2 will be 4.8 ms each; the duration of sub-frame SF3 will be 15.2 ms for a frame duration of 20 ms corresponding to a frame rate of 50 Hz.

In FIG. 3 the pixel connected to control lines 31 and 42 will close the TFT switch 50 during the time $t_2$ to $t_3$ a pulse is on the row control line 31, corresponding to the second row of the matrix. The instantaneous voltage $V_s$ present on the column control line 42 in the period $t_2$-$t_3$ will be set on the electrode 15 and, if a storage capacitor is present, on a plate of the storage capacitor 55.

The pixel voltage $V_p$, i.e. the voltage applied between the electrode 15 and the second fluid 13, is equal to $V_s$−$V_c$. If for example $V_s$ is −10 V and $V_c$ is −15 V, $V_p$ is +5 V. At time $t_3$, i.e. the end of the gate pulse, the TFT switch 50 opens and the capacitors 54 and 55 will be floating. Hence, the voltage on the capacitor 54 is maintained, except for current leakage. The fluids in the pixel will adjust their configuration to the voltage $V_p$. The adjustment typically takes a few milliseconds. Hence, the display state of the pixel will be shown within the sub-frame SF1 of the sub-frame has a length of 4.8 ms.

The voltage $V_p$ will be maintained on the pixel till the pixel is addressed at time $t_5$ in the second sub-frame SF2. The change of the common voltage $V_c$ at $t_4$ will not affect $V_p$, because the capacitor 54 is floating at that moment in time. Since the storage capacitor 55, if present, is connected in parallel to the capacitor 54, a change in $V_c$ will not affect the pixel voltage. In contrast, the storage capacitor of a known display device is not connected to the electrode 19 but to a constant voltage. Hence, any change in the common voltage will affect the pixel voltage in the known display device.

At time $t_5$ the row control line 31 is addressed again and the TFT passes the instantaneous voltage $V_s$ on the electrode 15. At this moment the changed voltage $V_c$ takes effect and will influence the pixel. If for example $V_s$ is +10 V and $V_c$ is +15 V, $V_p$ is $V_s$–$V_c$, which is −5 V. If the configuration of the fluids in the space 11 of the pixel are not sensitive to the polarity of the pixel voltage, the same display state will be maintained in sub-frames SF1 and SF2.

During the third sub-frame SF3 the TFT 50 is open and the pixel voltage $V_p$ will be maintained. $V_p$ may change when the pixel is addressed again at time $t_9$. Hence, the display state is maintained during a first display period DP1, i.e. from $t_2$ to $t_9$. SF3 is therefore a hold stage, in which no pixels of the row are addressed. At $t_9$ a second display period DP2 starts. The duration of a display period DP is the same as the duration of a frame F; the display period and frame coincide for the first row of the matrix and are shifted in time for the other rows.

A similar time diagram can be drawn for the next pixel in the row connected to control line 31; however, the source voltages $V_s$ will be different from the ones shown in FIG. 3. The time diagram for the pixel in the next row is also similar to FIG. 3 but with the pulse $V_g$ moved one position to the right, starting at $t_3$ instead of $t_2$.

The second frame F2 in FIG. 3 has also a polarity inversion of $V_p$ at time $t_{12}$. In addition, the polarity in the Figure changes at the start of the second frame, at time $t_9$. A third pixel voltage $V_p$ in a last portion of the display period DP1 ($t_7$-$t_9$), −5 V in the Figure, is changed to a positive fourth voltage in the first portion of the display period DP2 ($t_9$-$t_{12}$), the fourth voltage corresponding to the display state to be shown by the pixel in display period DP2. The two portions may be consecutive, but may also be separated by an intermediate period. The polarity change improves the response of the pixel in frame F2.

The display period DP1 in FIG. 3 shows a pixel voltage $V_p$ that can be represented as: + − h, i.e. positive voltage, negative voltage, hold stage. The display period may alternatively have for example: − + h, + h − h, − h + h, + − + h, − + − h, etc. Additionally, the polarity at the transition from one display state to the next may remain the same or change.

If the configuration of the fluids depends on the polarity of the pixel voltage, the pixel voltages in the sub-frames SF1 and SF2 must be set at a different magnitude to compensate for the dependence. The dependence may relate to a difference in offset and/or a different shape of response curve of the pixel, i.e. the display effect versus pixel voltage curve. The offset compensates for a difference in threshold voltage between the response curve of the pixel for positive and negative pixel voltages. For example a pixel voltage of +5.0 V in SF1 may give the same display state as −5.1 V in SF2. The different magnitudes can be set by using converter 37 (see FIG. 2) in SF1 and converter 38 in SF2. They provide different gamma corrections for positive and negative pixel voltages by applying a different shape of a pixel voltage versus input data curve. This provides an improved solution to offset differences compared to a known solution.

The converters 37 and 38 may also take into account the so-called kickback, in which a change in $V_g$ affects $V_p$ through a parasitic gate-drain capacitor of the TFT 50. Methods for compensation of the kickback are described in inter alia patents U.S. Pat. No. 6,392,626 and U.S. Pat. No. 7,834,837.

The compensation for the polarity dependence of the fluids configuration can be used in any display device using inversion of the pixel voltage. It can be used in embodiments where the polarity is inverted only at the start of a frame, i.e. in the first sub-frame SF1, or both at the start of a frame and during the frame.

The embodiment of the method shown in FIG. 3 has a frame Fl including two consecutive sub-frames SF1 and SF2 in which the rows of the matrix are being scanned and the polarity of the pixel voltage is inverted, and subsequently a hold period SF3 without scanning The first pixel voltage set during SF1 is applied to the pixel for a first portion $t_2$ to $t_5$ of the display period $t_2$-$t_9$. The second pixel voltage with inverse polarity and set during SF2, is applied to the pixel for a second portion $t_5$ to $t_9$. In FIG. 3 the first portion is shorter than the second portion; the first portion has the duration of a scan period, i.e. the period necessary for subsequently addressing all lines of an active matrix display device.

Alternatively, the frame F1 may include the sub-frame SF1, followed by a hold period, the sub-frame SF2, and another hold period. In this case, the first portion and the second portion can be equal. The first and second portions are also equal where the durations of the first and second sub-frames is equal to the duration of the frame.

In the embodiment of the method shown in FIG. 3 there is a polarity inversion in the first sub-frame SF1 at the start of the frame F1 and in the second sub-frame SF2 during the frame F1. Alternatively, the first sub-frame may use the same polarity of the pixel voltage as at the end of the preceding frame and sub-frame SF2 inverts the polarity during the frame. For longer durations of the frame the number of polarity inversions in a frame may be made larger than two, e.g. three, four or more.

The use of a voltage $V_c$ alternating periodically around zero volt as in the embodiment of FIG. 3 has the effect that a swing of 30 V of the pixel voltage can be achieved with a circuit operating at −15-+15V power supply, which has a lower manufacturing cost than a driving circuit operating at 0-30 V power supply. Another effect is the lower power consumption of the circuit. Alternatively, the display device may be operated using a voltage $V_c$ that alternates between 0 V and a positive voltage, e.g. 30 V, or between 0V and a negative voltage, e.g. −30 V, or using a DC voltage for $V_c$. In these alternative cases the voltages $V_s$ must be changed accordingly.

Other embodiments relate to a display device having storage capacitors 55 in the pixels connected in parallel with the electrode—second fluid capacitors 54 as shown in FIG. 2. This display device may be driven using a method in which the polarity is changed one or more times in a frame or once in two or more consecutive frames. The display device may be driven with or without the dual converters 37 and 38 shown in FIG. 2.

Further embodiments relate to a display apparatus having the dual converters 37 and 38. This display apparatus may be driven using a method in which the polarity is changed between a first period and a second period. The first and second period may be portions of a single display period or may be display periods. The display device may have storage capacitors connected as shown in FIG. 2.

The polarity inversion of the pixel voltage appears to have an effect on maintenance of the display state during a display period similar to a known reset pulse technique. The polarity inversion requires fewer scans addressing the rows than a reset pulse: a polarity inversion requires one scan and a reset pulse requires two scans. Hence, a polarity inversion can be carried out faster than a reset pulse. Moreover, polarity inversion requires less energy than reset pulses, because the charge of a pixel is changed twice for a reset pulse and only once for a polarity inversion. Note, that the voltage applied to a pixel during a reset pulse is usually a maximum or a minimum voltage; it is not a voltage corresponding to a display state maintained during a display period. The duration of a reset pulse must be short enough to make any change in display state invisible. In contrast, the sub-frames in which the polarity is changed may have a duration long enough to make the change in display state visible.

The above embodiments are to be understood as illustrative examples. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the accompanying claims.

What is claimed is:

1. A method of driving an electrowetting picture element to substantially maintain a first display state of the electrowetting picture element during a first frame, the method comprising:

applying a first picture element voltage to the electrowetting picture element during a first sub-frame of the first frame, the first picture element voltage corresponding to the first display state and having a first picture element voltage polarity;

applying a second picture element voltage to the electrowetting picture element during a second sub-frame of the first frame, the second picture element voltage corresponding to the first display state, the second picture element voltage having a second picture element voltage polarity different from the first picture element voltage polarity; and holding the electrowetting picture element at the second picture element voltage during a third sub-frame of the first frame.

2. The method according to claim 1, wherein the first sub-frame is one of: shorter than or equal to the second sub-frame.

3. The method according to claim 1, further comprising:

applying a third picture element voltage corresponding to the first display state during a last sub-frame of the first frame, the last sub-frame being the third sub-frame or different from the third sub-frame, the third picture element voltage having a third picture element voltage polarity, and applying a fourth picture element voltage corresponding to a second display state during a first sub-frame of a second frame, the second frame subsequent to the first frame, the fourth picture element voltage having a fourth picture element voltage polarity different from the third picture element voltage polarity.

4. The method according to claim 1, wherein the applying the first picture element voltage to the electrowetting picture element comprises applying the first picture element voltage between a first electrode of a first support plate of the electrowetting picture element and a second electrode of the electrowetting picture element, the electrowetting picture element further comprising:

a second support plate;

a first fluid; and a second fluid immiscible with the first fluid, the second fluid being one or more of: electroconductive or polar, the first fluid and the second fluid located between the first support plate and the second support plate, the second electrode in electrical contact with the second fluid; and the applying the second picture element voltage to the electrowetting picture element comprises applying the second picture element voltage between the first electrode and the second electrode, the method further comprising applying an alternating voltage to the second electrode.

5. The method according to claim 1, wherein the electrowetting picture element comprises a storage capacitor directly connected between the first electrode and the second electrode.

6. The method according to claim 1, wherein the third sub-frame is subsequent to the second sub-frame, and the second sub-frame is subsequent to the first sub-frame.

7. The method according to claim 1, wherein the third sub-frame is at least one of: longer than the first sub-frame or longer than the second sub-frame.

8. A method of driving an electrowetting display device comprising an electrowetting picture element, the method comprising:

applying a first picture element voltage having a first picture element voltage polarity and a first picture element voltage magnitude during a first period to provide a first display state; and applying a second picture element voltage having a second picture element voltage polarity, different from the first picture element voltage polarity, and a second picture element voltage magnitude, different from the first picture element voltage magnitude, during a second period to substantially maintain the first display state.

9. The method according to claim 8, wherein the first period is a first frame and the second period is a second frame.

10. The method according to claim 8, wherein the first period is a first sub-frame of a frame and the second period is a second sub-frame of the frame.

11. The method according to claim 10, wherein a duration of the first period is one of: shorter than or equal to a duration of the second period.

12. The method according to claim 8, comprising:

obtaining the first picture element voltage using a first conversion from display input data to picture element voltage magnitude; and obtaining the second picture element voltage using a second conversion, different from the first conversion, from display input data to picture element voltage magnitude.

13. The method according to claim 12, wherein the using the first conversion comprises applying a first offset voltage and the using the second conversion comprises applying a second offset voltage different from the first offset voltage.

14. The method according to claim 12, wherein the using the first conversion comprises applying a first picture element voltage versus input data curve having a first shape and the using the second conversion comprises applying a second picture element voltage versus input data curve having a second shape different from the first shape.

15. A display driving system for driving an electrowetting display device, the display driving system comprising:

an input for display input data;

an output for providing a picture element voltage to an electrowetting picture element of the electrowetting display device; and a processor for converting the display input data to the picture element voltage, the processor adapted for carrying out a method of driving the electrowetting picture element to substantially maintain a first display state of the electrowetting picture element during a first frame, the method comprising:

applying a first picture element voltage to the electrowetting picture element during a first sub-frame of the first frame, the first picture element voltage corresponding to the first display state and having a first picture element voltage polarity;

applying a second picture element voltage to the electrowetting picture element during a second sub-frame of the first frame, the second picture element voltage corresponding to the first display state, the second picture element voltage having a second picture element voltage polarity different from the first picture element voltage polarity; and holding the electrowetting picture element at the second picture element voltage during a third sub-frame of the first frame.

16. The display driving system according to claim 15, wherein the first sub-frame is one of: shorter than or equal to the second sub-frame.

17. The display driving system according to claim 15, the method further comprising:

applying a third picture element voltage corresponding to the first display state during a last sub-frame of the first frame, the last sub-frame being the third sub-frame or different from the third sub-frame, the third picture element voltage having a third picture element voltage polarity, and applying a fourth picture element voltage corresponding to a second display state during a first sub-frame of a second frame, the second frame subsequent to the first frame, the fourth picture element voltage having a fourth picture element voltage polarity different from the third picture element voltage polarity.

18. A display driving system for driving an electrowetting display device, the display driving system comprising:

an input for display input data;

an output for providing a picture element voltage to an electrowetting picture element of the electrowetting display device; and a processor for converting the display input data to the picture element voltage, the processor adapted for carrying out a method comprising:

applying a first picture element voltage having a first picture element voltage polarity and a first picture element voltage magnitude during a first period to provide a first display state; and applying a second picture element voltage having a second picture element voltage polarity, different from the first picture element voltage polarity, and a second picture element voltage magnitude, different from the first picture element voltage magnitude, during a second period to substantially maintain the first display state.

19. The display driving system according to claim 18, wherein the processor is adapted to:

obtain the first picture element voltage using a first conversion from display input data to picture element voltage magnitude; and obtain the second picture element voltage using a second conversion, different from the first conversion, from display input data to picture element voltage magnitude.

20. The display driving system according to claim 18, comprising:

a first converter configured to perform a first conversion from display input data to picture element voltage magnitude to obtain the first picture element voltage; and a second converter configured to perform a second conversion from display input data to picture element voltage magnitude to obtain the second picture element voltage.

21. The display driving system according to claim 18, comprising a convertor comprising:

a first look-up table for use in a first conversion from display input data to picture element voltage magnitude for the first picture element voltage; and a second look-up table for use in a second conversion from display input data to picture element voltage magnitude for the second picture element voltage.

22. A display apparatus comprising a display device and a display driving system for driving the display device, the display device comprising an electrowetting picture element comprising:

a first support plate comprising a first electrode;

a second support plate;

a first fluid;

a second fluid immiscible with the first fluid, the second fluid being one or more of: electroconductive or polar, the first fluid and the second fluid located between the first support plate and the second support plate; and a second electrode in electrical contact with the second fluid; and the display driving system comprising:

an input for display input data;

an output for providing a picture element voltage to the electrowetting picture element of the display device; and a processor for converting the display input data to the picture element voltage, the processor adapted for carrying out a method of driving the electrowetting picture element to substantially maintain a first display state of the electrowetting picture element during a first frame, the method comprising:

applying a first picture element voltage to the electrowetting picture element during a first sub-frame of the first frame, the first picture element voltage corresponding to the first display state and having a first picture element voltage polarity;

applying a second picture element voltage to the electrowetting picture element during a second sub-frame of the first frame, the second picture element voltage corresponding to the first display state, the second picture element voltage having a second picture element voltage polarity different from the first picture element voltage polarity; and holding the electrowetting picture element at the second picture element voltage during a third sub-frame of the first frame.

23. The display apparatus according to claim 22, wherein the first sub-frame is one of: shorter than or equal to the second sub-frame.

24. The display apparatus according to claim 22, the method further comprising:

applying a third picture element voltage corresponding to the first display state during a last sub-frame of the first frame, the last sub-frame being the third sub-frame or different from the third sub-frame, the third picture element voltage having a third picture element voltage polarity, and applying a fourth picture element voltage corresponding to the second display state during a first sub-frame of a second frame, the second frame subsequent to the first frame, the fourth picture element voltage having a fourth picture element voltage polarity different from the third picture element voltage polarity.

* * * * *